US006637195B2

(12) United States Patent
Sakai et al.

(10) Patent No.: US 6,637,195 B2
(45) Date of Patent: Oct. 28, 2003

(54) APPARATUS AND METHOD FOR ENGINE EXHAUST PURIFICATION

(75) Inventors: Atsushi Sakai, Yokohama (JP); Hajime Oguma, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/106,024

(22) Filed: Mar. 27, 2002

(65) Prior Publication Data

US 2002/0157382 A1 Oct. 31, 2002

(30) Foreign Application Priority Data

Apr. 27, 2001 (JP) ..... 2001-131481

(51) Int. Cl.[7] ..... F01N 3/00

(52) U.S. Cl. ..... 60/285; 60/274; 60/276; 60/277; 701/109

(58) Field of Search ..... 60/274, 276, 285, 60/277, 286, 297; 701/103, 109

(56) References Cited

U.S. PATENT DOCUMENTS 5,293,740 A 3/1994 Heppner et al.
5,609,023 A 3/1997 Katoh et al.
5,678,402 A * 10/1997 Kitagawa et al. ..... 60/276
5,842,339 A 12/1998 Bush et al.
5,842,340 A 12/1998 Bush et al.
6,116,021 A * 9/2000 Schumacher et al. ..... 60/274
6,185,933 B1 2/2001 Tsuzuki et al.
6,289,673 B1 * 9/2001 Tayama et al. ..... 60/285
6,357,224 B1 * 3/2002 Kawamoto et al. ..... 60/277
6,481,201 B2 * 11/2002 Kako et al. ..... 60/285
6,499,290 B1 * 12/2002 Nakamura et al. ..... 60/274

FOREIGN PATENT DOCUMENTS

WO WO 01/63109 8/2001

OTHER PUBLICATIONS

Patent Abstracts of Japan, vol. 1998, No. 12, Oct. 13, 1998, JP 10–184426.

* cited by examiner

*Primary Examiner*—Thomas Denion
*Assistant Examiner*—Binh Tran
(74) *Attorney, Agent, or Firm*—Foley & Lardner

(57) ABSTRACT

An oxygen storage amount of a catalyst is estimated by a controller in accordance with a sensed air-fuel ratio of an inflowing exhaust gas mixture flowing into the catalyst, and a sensed intake air amount of the engine, to control the air-fuel ratio of the engine. The estimated oxygen storage amount is corrected to reduce an error in computing the estimated oxygen storage amount when a downstream exhaust condition sensed by an exhaust sensor disposed on the downstream of the catalyst becomes equal to a predetermined threshold, which is modified in accordance with the intake air amount for better emission control performance.

16 Claims, 11 Drawing Sheets

APPARATUS AND METHOD FOR ENGINE EXHAUST PURIFICATION

BACKGROUND OF THE INVENTION

The present invention relates to technique of purifying exhaust gases of engine, and more specifically to apparatus and method of exhaust emission control for an engine equipped with a catalyst.

For maximizing the conversion efficiency of NOx, CO, and HC in three-way catalyst, the control of oxygen storage amount in the catalyst is effective. In this case, a catalyst system can control the atmosphere of the catalyst around stoichiometry to maximize the conversion efficiency, by controlling the oxygen storage amount at a constant level so that oxygen in exhaust gases is stored in the catalyst in the case of deviation of the exhaust gases flowing into the catalyst to the lean side, and that oxygen is released from the catalyst in the case of deviation to the rich side.

SUMMARY OF THE INVENTION

An object of the present invention is to further reduce exhaust emissions in technique of computing an oxygen storage amount in a catalyst.

According to one aspect of the present invention, an engine exhaust purifying apparatus comprises: an air flow sensor, a catalyst, an upstream exhaust sensor, a downstream exhaust sensor and a controller. The air flow sensor is arranged to sense an engine intake air amount. The catalyst is disposed in an engine exhaust passage. The upstream exhaust sensor is disposed in the engine exhaust passage on an upstream side of the catalyst, and arranged to sense an upstream exhaust condition representing an air-fuel ratio of an inflowing exhaust gas mixture flowing into the catalyst. The downstream exhaust sensor is disposed on a downstream side of the catalyst and arranged to sense a downstream exhaust condition representing an air-fuel ratio of an outflowing exhaust gas mixture flowing out of the catalyst. The controller is configured; to compute an estimated oxygen storage amount of the catalyst in accordance with the air-fuel ratio of the inflowing exhaust gas mixture and the engine intake air amount; to control an air-fuel ratio of the engine in accordance with the estimated oxygen storage amount so as to bring an actual oxygen storage amount of the catalyst to a desired value; to correct the estimated oxygen storage amount to reduce an error in computing the estimated oxygen storage amount when the downstream exhaust condition sensed by the downstream exhaust sensor becomes equal to a predetermined threshold; and to modify the threshold in accordance with the intake air amount.

According to another aspect of the present invention, an engine exhaust purifying process for an engine equipped with a catalyst disposed in an engine exhaust passage, comprises: computing an estimated oxygen storage amount of the catalyst in accordance with a sensed upstream exhaust condition representing an air-fuel ratio of an inflowing exhaust gas mixture flowing into the catalyst and a sensed engine intake air amount; controlling an air-fuel ratio of the engine in accordance with the estimated oxygen storage amount; correcting the estimated oxygen storage amount to reduce an error in computing the estimated oxygen storage amount when a downstream exhaust condition representing an air-fuel ratio of an outflowing exhaust gas mixture flowing out of the catalyst becomes equal to a predetermined threshold; and modifying the threshold in accordance with the sensed engine intake air amount.

According to still another aspect of the present invention, an engine exhaust purifying apparatus for an engine equipped with a catalyst, comprises: means for sensing an engine intake air amount; means for sensing an upstream exhaust condition representing an air-fuel ratio of an inflowing exhaust gas mixture flowing into the catalyst; means for sensing an downstream exhaust condition representing an air-fuel ratio of an outflowing exhaust gas mixture flowing out of the catalyst; and means for computing an estimated oxygen storage amount of the catalyst in accordance with the upstream exhaust condition of the inflowing exhaust gas mixture and the engine intake air amount; means for controlling an air fuel ratio of the engine in accordance with the oxygen storage amount; means for correcting the estimated oxygen storage amount to reduce an error in computing the estimated oxygen storage amount when the downstream exhaust condition sensed by said means for sensing the downstream exhaust condition becomes equal a predetermined threshold; and means for modifying the threshold in accordance with the intake air amount.

The other objects and features of this invention will become understood from the following description with reference to the accompanying drawings.

DETAILED DESCRIPTION OF THE INVENTION

Figure 1:
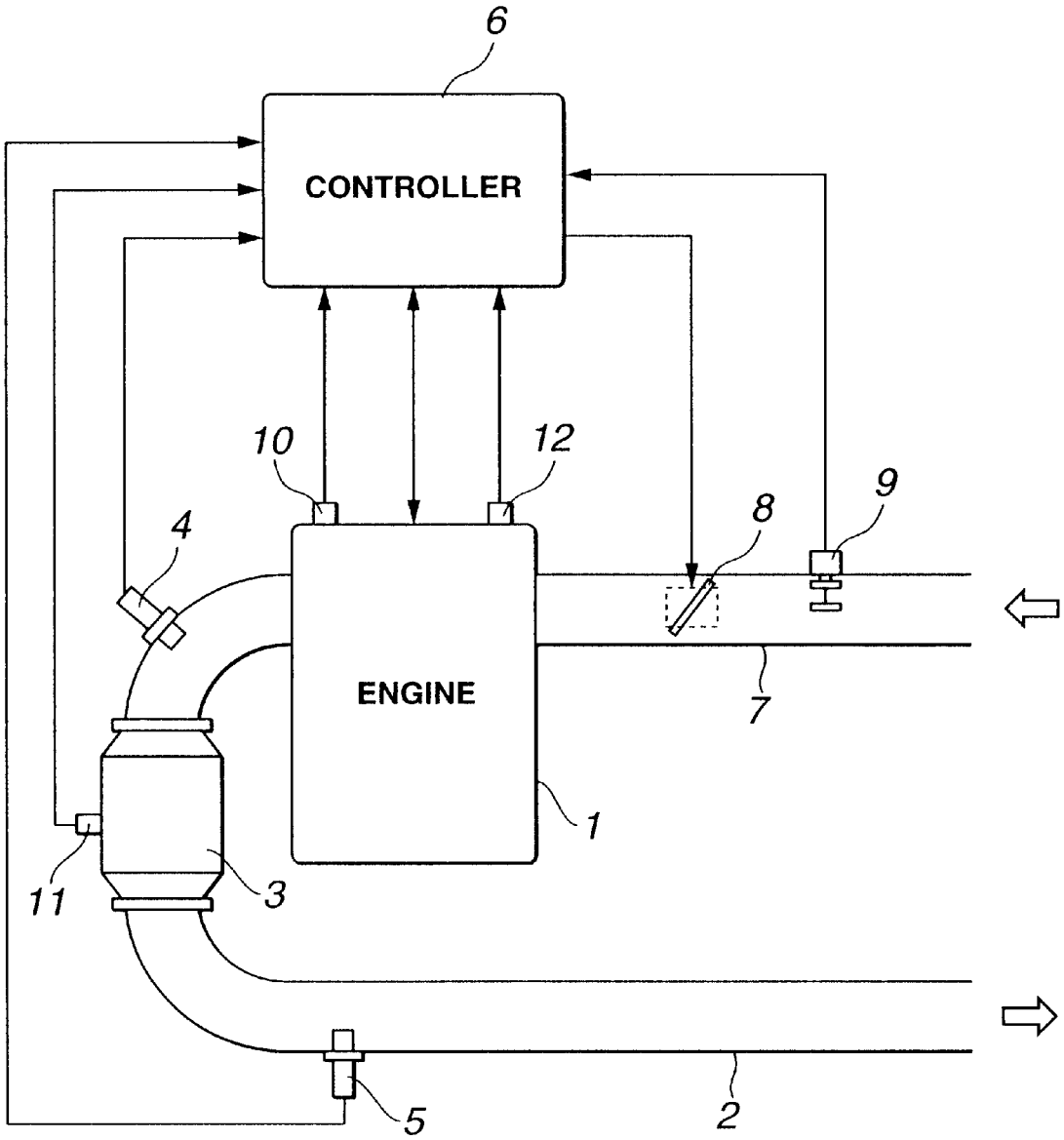
FIG. 1 is a schematic view showing an exhaust purifying apparatus according to one embodiment of the present invention.

FIG. 1 shows an exhaust gas purifying apparatus (or exhaust purification arrangement) according to one embodiment of the present invention. An engine 1 of this example is a spark ignition engine. The exhaust gas purifying apparatus includes a catalyst (or catalytic converter) 3 disposed in an exhaust passage 2 for engine 1, an upstream exhaust sensor (front A/F sensor) 4 for sensing an exhaust condition on the upstream side of catalyst 3, a downstream exhaust sensor (rear O2 sensor) 5 for sensing an exhaust condition on the downstream side of catalyst 3, and a controller 6.

In an intake passage 7 for engine 1, there are provided a throttle valve 8 and an air flowmeter (or air flow sensor) 9 for sensing an intake air quantity Qa regulated by throttle valve 8. Throttle valve 8 of this example is an electronically controlled throttle valve which can be controlled independently of driver's accelerator pedal operation. Engine 1 is provided with an engine coolant temperature sensor 10 and a crank angle sensor 12 for sensing an engine speed.

Catalyst 3 of this example is a three-way catalyst capable of purifying NOx, HC and CO at a maximum efficiency when the catalyst atmosphere is in a condition of the stoichiometric air/fuel ratio. In catalyst 3, catalyst carrier is coated with an oxygen storage material such as ceria (cerium oxide), and catalyst 3 can perform an oxygen storage function of storing (or absorbing) and releasing oxygen in accordance with the air-fuel ratio of inflowing exhaust gas mixture.

An oxygen storage amount in catalyst 3 is composed of a high speed component HO2 determined by the storage and release in noble metal (such as Pt, Rh, Pd) in catalyst 3, and a low speed component LO2 determined by the storage and release in the oxygen storage material of catalyst 3. Low speed component LO2 is characterized by a larger capacity of storing and releasing a larger amount of oxygen than the capacity of the high speed component. However, the storage/release rate or speed is slower in the case of low speed component LO2 than in the high speed component HO2.

Moreover, the high speed component HO2 and low speed component LO2 have the following characteristics.

As to oxygen storage operation, oxygen is stored preferentially in the high speed component HO2 until a maximum capacity HO2MAX of high speed component HO2 is reached. Thereafter, when the high speed component HO2 becomes unable to store more, the low speed component LO2 starts to store oxygen.

As to oxygen release operation, oxygen is released preferentially from high speed component HO2 when the ratio (LO2/HO2) of the low speed component LO2 to the high speed component HO2 is smaller than a predetermined value, i.e., when the high speed component HO2 is relatively large. When the ratio (LO2/HO2) of the low speed component LO2 to the high speed component HO2 is greater than or equal to the predetermined value, oxygen is released from both of the high speed component HO2 and low speed component LO2 so that the ratio (LO2/HO2) of the low speed component LO2 to the high speed component HO2 is held unchanged.

Upstream exhaust sensor of this example is a front A/F sensor 4 disposed on the upstream side of catalyst 3, and arranged to sense the air/fuel ratio of the exhaust gas mixture flowing into catalyst 3. Downstream exhaust sensor of this example is a rear O2 sensor 5 disposed on the downstream side of catalyst 3, and arranged to sense an oxygen concentration on the downstream side of catalyst 3 with reference to the stoichiometric air/fuel ratio in a manner of sensing inversion. Though the oxygen sensor is advantageous in cost, it is optional to employ, as rear exhaust sensor, a rear A/F sensor capable of linearly sensing the air/fuel ratio on the downstream side of catalyst 3.

Coolant temperature sensor 10 is arranged to sensor the temperature of a cooling water for engine 1. The temperature sensed by coolant temperature sensor 10 is used for determining an operating condition of engine 1, and for estimating the temperature of catalyst 3.

Controller 6 of this example is a computer unit including at least a microprocessor, RAM, ROM and I/O interface. Controller 6 determines an estimated oxygen storage amount (high speed component HO2 and low speed component LO2) of catalyst 3 by computation in accordance with sensor signals from air flowmeter 9, front A/F sensor 4 and temperature sensor 10.

When high speed component HO2 of the computed oxygen storage quantity is greater than a predetermined value (which, in this example, is set equal to a half of the maximum capacity HO2MAX of the high speed component HO2), controller 6 shifts the air-fuel ratio of engine 1 to the rich side, and thereby decreases high speed component HO2. When, on the other hand, the high speed component HO2 is smaller than the predetermined value, then controller 6 shifts the air-fuel ratio of engine 1 to the lean side, and thereby increases the high speed component HO2. Thus, controller 6 functions to hold the high speed component HO2 of the oxygen storage quantity constant.

Moreover, controller 6 corrects a deviation, caused by computation errors, between the computed (or estimated) oxygen storage quantity and the actual oxygen storage quantity, by resetting the oxygen storage quantity, at a predetermined timing, in accordance with the downstream exhaust condition on the downstream side of catalyst 3. In this example, the downstream exhaust condition is the oxygen concentration on the downstream side of catalyst 3.

When rear O2 sensor 5 signals a lean condition for a lean side judgment, controller 6 assumes that the high speed component HO2 at least is increased to its maximum, and resets the high speed component HO2 to the maximum capacity. When rear O2 sensor 5 signals a rich condition for a rich side judgment, controller 6 resets each of the low speed component LO2 and high speed component HO2 to a minimum capacity since oxygen is no longer released from high speed component HO2 and even from low speed component LO2.

The system of this example varies slice levels (rich side threshold RDT and lean side threshold LDT) for rich judgment and lean judgment of rear O2 sensor 5 in accordance with an engine operating condition of engine 1. In this example, the slice levels are shifted to the lean side as the intake air quantity Qa for engine 1 increases. The amount of exhaust emission passing through catalyst 3 without being purified, and hence the efficiency of purifying the exhaust emission are influenced by setting of the slice levels. Therefore, this system is configured to shift the slice levels to the lean side in accordance with the intake air quantity Qa so as to optimize the exhaust emission purifying efficiency.

Controller 6 serves as a central unit of a control system by performing various control operations. The following description is directed to computation of the oxygen storage amount, resetting of the oxygen storage amount and air/fuel ratio control based on the oxygen storage amount.

Figure 2:
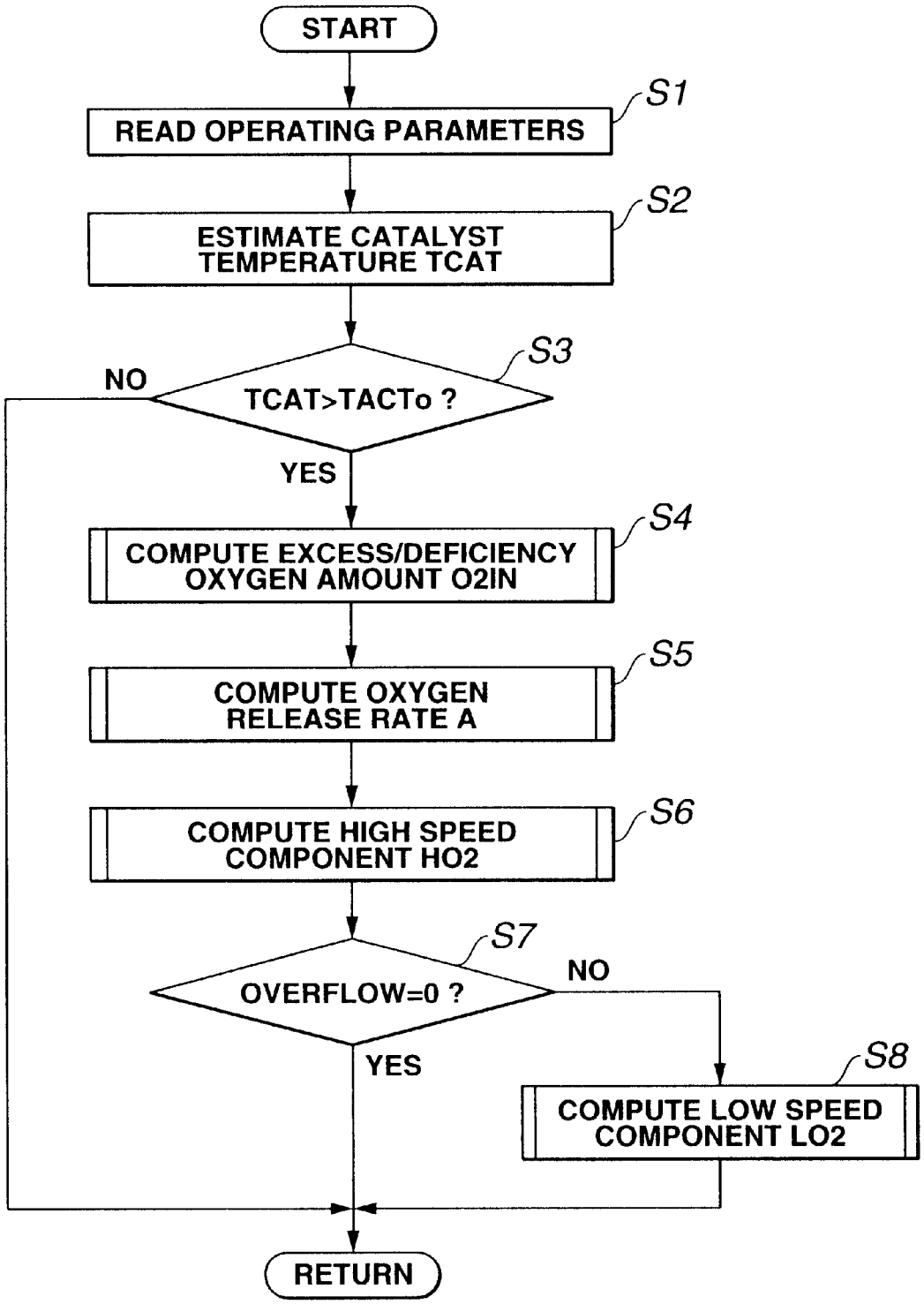
FIG. 2 is a flowchart showing a routine performed by the exhaust purifying apparatus of FIG. 1, for computing an estimated oxygen storage amount representing an amount of oxygen stored in a catalyst.

FIG. 2 shows a routine for computing or estimating the oxygen storage amount of catalyst 3. The routine is performed at regular intervals of a predetermined time length by controller 6.

Step S1 is a step for reading various engine operating parameters of engine 1. In this example, controller 6 reads sensor signals of coolant temperature sensor 10, crank angle sensor 12 and air flowmeter 9. In accordance with information obtained at step S1, controller 6 estimates the temperature TCAT of catalyst 3 at step S2. Step S3 determines whether catalyst 3 is activated or not, by comparing the estimated catalyst temperature TCAT with a catalyst activation temperature TACTo.

When estimated catalyst temperature TCAT is higher than activation temperature TCATo, then controller 6 proceeds from step S3 to step S4 to compute the oxygen storage quantity. When the catalyst temperature is still lower than or equal to activation temperature TCATo, then controller 6 terminates the routine, assuming that catalyst 3 is in the state performing no oxygen storage/release operation.

Figure 3:
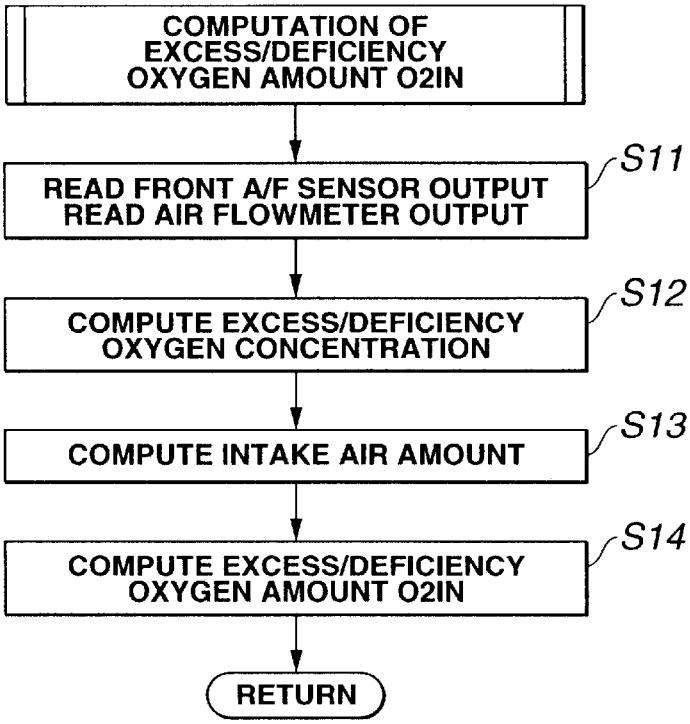
FIG. 3 is a flowchart showing a subroutine, performed by the exhaust purifying apparatus of FIG. 1, for computing an excess/deficiency oxygen amount of an inflowing exhaust gas mixture flowing into the catalyst.

At step S4, controller 6 computes an oxygen excess/deficiency amount O2IN in an inflowing exhaust gas mixture flowing into catalyst 3, by a subroutine shown in FIG. 3. At next step S5, controller 6 computes an oxygen release rate A of the high speed component of the oxygen storage amount, by performing a subroutine shown in FIG. 4.

Figure 5:
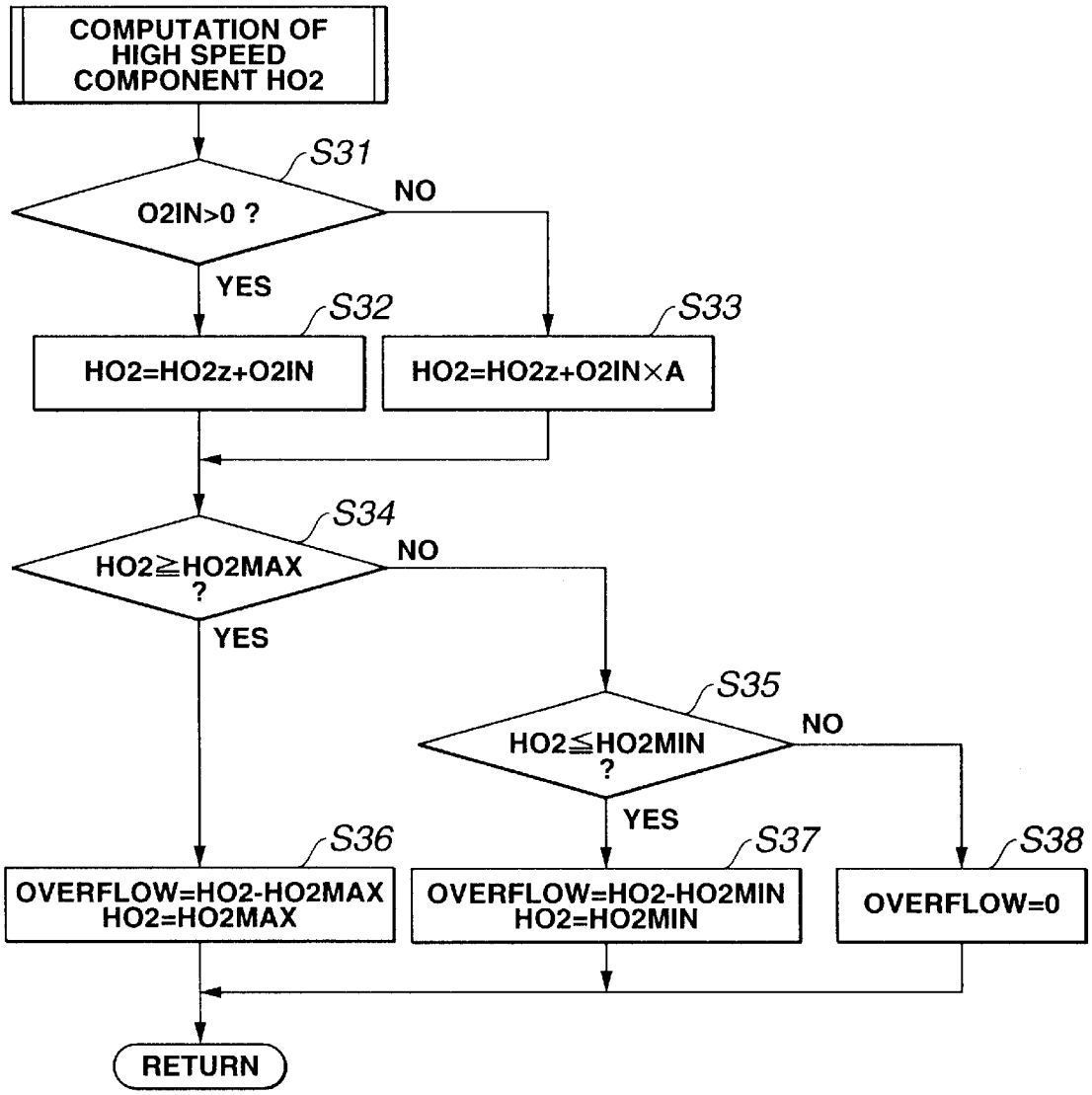
FIG. 5 is a flowchart showing a subroutine performed by the exhaust purifying apparatus of FIG. 1, for computing a high speed component (HO2) of the oxygen storage amount.

At step S6, controller 6 computes an overflow amount OVERFLOW representing a quantity of oxygen overflowing into the low speed component LO2 without being stored in the high speed component HO2, by performing a subroutine of FIG. 5, for computing the high speed component HO2 of the oxygen storage amount. Overflow amount OVERFLOW is determined in accordance with oxygen excess/deficiency amount O2IN and oxygen release rate A of high speed component HO2.

At step S7, controller 6 determines whether all the oxygen excess/release amount O2IN of the inflowing exhaust gas mixture flowing into catalyst 3 is stored as high speed component HO2, or not, by checking the overflow amount OVERFLOW. When oxygen excess/deficiency amount O2IN is stored entirely in the high speed component, and hence overflow amount is equal to zero (OVERFLOW=0), then controller 6 terminates the routine of FIG. 2. When overflow amount OVERFLOW is not equal to zero, controller 6 proceeds from step S7 to step S8, and computes the low speed component LO2 in accordance with overflow amount OVERFLOW representing the quantity of overflow from high speed component HO2, by a routine shown in FIG. 6.

In the above-mentioned example, the catalyst temperature TCAT is estimated from the engine coolant temperature, engine load and engine speed. However, it is optional to employ a temperature sensor 11, disposed in catalyst 3 as shown in FIG. 1, for directly sensing the temperature of catalyst 3.

In the example shown in FIG. 2, step S3 is interposed to omit the computation of oxygen storage quantity when catalyst temperature TCAT is lower than activation temperature TCATo. It is, however, optional to eliminate step S3, and to design the routine so as to reflect the influence from catalyst temperature, in the oxygen release rate A of high speed component HO2 and oxygen storage/release rate B of low speed component LO2.

FIG. 3 shows the subroutine (of step S4) for computing the oxygen excess/deficiency amount O2IN of the inflowing exhaust gas mixture flowing into catalyst 3. This subroutine is designed to compute the oxygen excess/deficiency amount in accordance with the air-fuel ratio on the upstream side of catalyst 3, and the intake air amount of engine 1.

Step S11 of FIG. 3 obtains input information by reading signals from front A/F sensor 4 and air flowmeter 9.

Step S12 computes an excess/deficiency oxygen concentration of the inflowing exhaust gas mixture flowing into catalyst 3, by conversion from the signal of front A/F sensor 4 to the air/fuel ratio by using a predetermined conversion table. The excess/deficiency oxygen concentration is a relative oxygen concentration with reference to the oxygen concentration at the stoichiometric air/fuel ratio. The excess/deficiency oxygen concentration is zero when the inflowing exhaust gas mixture is at the stoichiometric ratio, negative on the rich side, and positive on the lean side.

Step S13 converts the output of air flowmeter 9 into intake air amount by using a predetermined conversion table. Step S14 computes excess/deficiency oxygen amount O2IN of the inflowing exhaust gas mixture flowing into catalyst 3, by multiplying the intake air amount determined by step S13, by the excess/deficiency oxygen concentration determined by step S12. Since the excess/deficiency oxygen concentration is zero, negative and positive in accordance with the air/fuel ratio, as mentioned before, the excess/deficiency oxygen amount O2IN is zero when the inflowing exhaust gas mixture is at the stoichiometry, negative when the inflowing exhaust gas mixture is rich, and positive when the inflowing exhaust gas mixture is lean.

Figure 4:
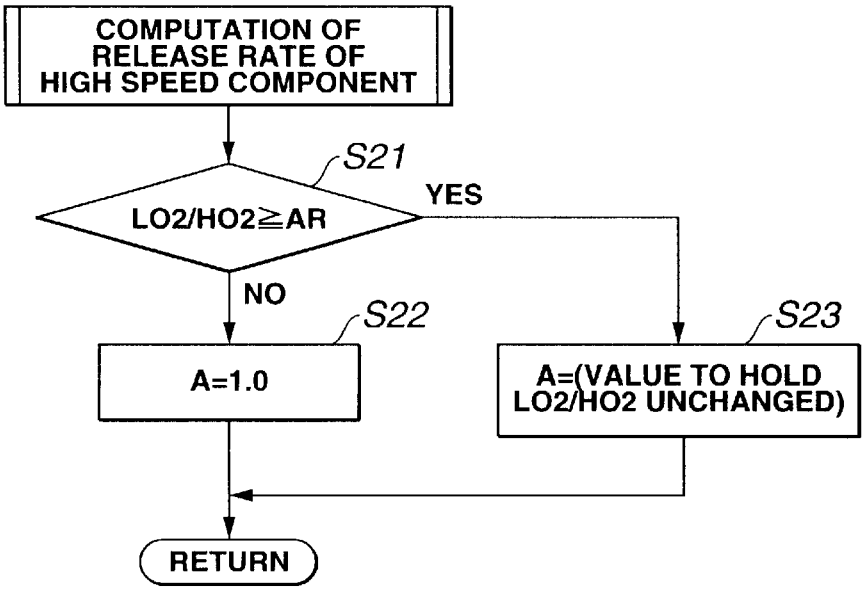
FIG. 4 is a flowchart showing a subroutine performed by the exhaust purifying apparatus of FIG. 1, for computing an oxygen release rate of high speed component.

FIG. 4 shows the subroutine (of step S5) for computing the oxygen release rate A of high speed component HO2. The oxygen release rate of high speed component HO2 receives influence from the low speed component LO2. Therefore, this subroutine is arranged to compute the high speed oxygen release rate A in accordance with low speed component LO2.

First, step S21 determines whether a ratio LO2/HO2 of low speed component LO2 to high speed component HO2 is greater than or equal to a predetermined value AR. (In one example, AR is greater than one, and AR=10) When high speed component HO2 is relatively great as compared to low speed component LO2, and hence the ratio LO2/HO2 is smaller than AR, then controller 6 proceeds from step S21 to step S22, and sets the oxygen release rate A of high speed component equal to 1.0 (A=1.0) on the assumption that oxygen is released first from high speed component HO2.

When ratio LO2/HO2 is greater than or equal to AR, oxygen is released from high speed component HO2 and low speed component LO2 so that ratio LO2/HO2 remains unchanged. In this case, therefore, controller 6 proceeds from step S21 to step S23, and computes such a value of the oxygen release rate A of high speed component as to hold the ratio LO2/HO2 unchanged.

FIG. 5 shows the subroutine (of step S6) for computing high speed component HO2 of the oxygen storage amount. The subroutine of this example is arranged to compute high speed component HO2 in accordance with oxygen excess/deficiency quantity O2IN of the inflowing exhaust gas mixture flowing into catalyst 3, and oxygen release rate A of high speed component HO2.

Step S31 of FIG. 5 checks whether excess/deficiency oxygen amount O2IN is greater than zero, and thereby determines whether the high speed component HO2 is in a state for storing oxygen or in a state for releasing oxygen.

When the inflowing exhaust gas mixture flowing into catalyst 3 is lean, and hence excess/deficiency oxygen amount O2IN is greater than zero, then controller 6 proceeds to step S32 on the assumption that high speed component HO2 is in the state for storing oxygen. At step S32, controller 6 computes high speed component HO2 according to the following equation (1).

$$HO2=HO2z+O2IN \quad (1)$$

HO2z: a previous (most recent) value of high speed component HO2

When oxygen excess/deficiency amount O2IN is smaller than or equal to zero, and the high speed component is considered to be in the state for releasing oxygen, then controller 6 proceeds from step S31 to step S33, and computes high speed component HO2 according to the following equation (2).

$$HO2=HO2z+O2IN\times A \quad (2)$$

A: the oxygen releasing rate of high speed component HO2

Steps S34 and S35 are steps for examining whether the thus-computed high speed component HO2 determined at step S32 or S33 is greater than or equal to a maximum capacity HO2MAX of high speed component, and whether the component HO2 determined at step S32 or S33 is smaller than or equal to a minimum capacity HO2MIN (=0) of high speed component.

When high speed component HO2 is greater than or equal to maximum capacity HO2MAX, controller 6 proceeds from S34 to S36, and computes overflow amount (excess amount) OVERFLOW representing an amount of oxygen flowing over without being stored in high speed component HO2, according to the following equation (3).

$$\text{OVERFLOW}=HO2-HO2\text{MAX} \quad (3)$$

Moreover, high speed component HO2 is limited to maximum capacity HO2MAX (H2O=HO2MAX) at step S36.

When high speed component HO2 is smaller than or equal to minimum capacity HO2MIN, controller 6 proceeds from S35 to S37, and computes overflow amount (deficient amount) OVERFLOW representing the amount of oxygen flowing over without being stored in high speed component HO2 according to the following equation (4).

$$\text{OVERFLOW}=HO2-HO2\text{MIN} \quad (4)$$

Moreover, high speed component HO2 is limited to minimum capacity HO2MIN (H2O=HO2MIN) at step S37. In this example, minimum capacity HO2MIN is set equal to zero. Therefore, the system computes, as a negative overflow amount, a deficient oxygen amount in the state in which high speed component HO2 is released entirely.

When high speed component HO2 is intermediate between maximum and minimum capacities HO2MAX and HO2MIN, then controller 6 proceeds from step S35 to step S38, and sets overflow amount OVERFLOW to zero since oxygen excess/deficiency amount of the inflowing exhaust gas mixture flowing into catalyst 3 is all stored in high speed component HO2.

In the case of high speed component HO2 being equal to or greater than maximum capacity HO2MAX, or equal to or smaller than minimum capacity HO2MIN, overflow amount OVERFLOW flowing over from high speed component HO2 is stored or released at low speed component LO2.

Figure 6:
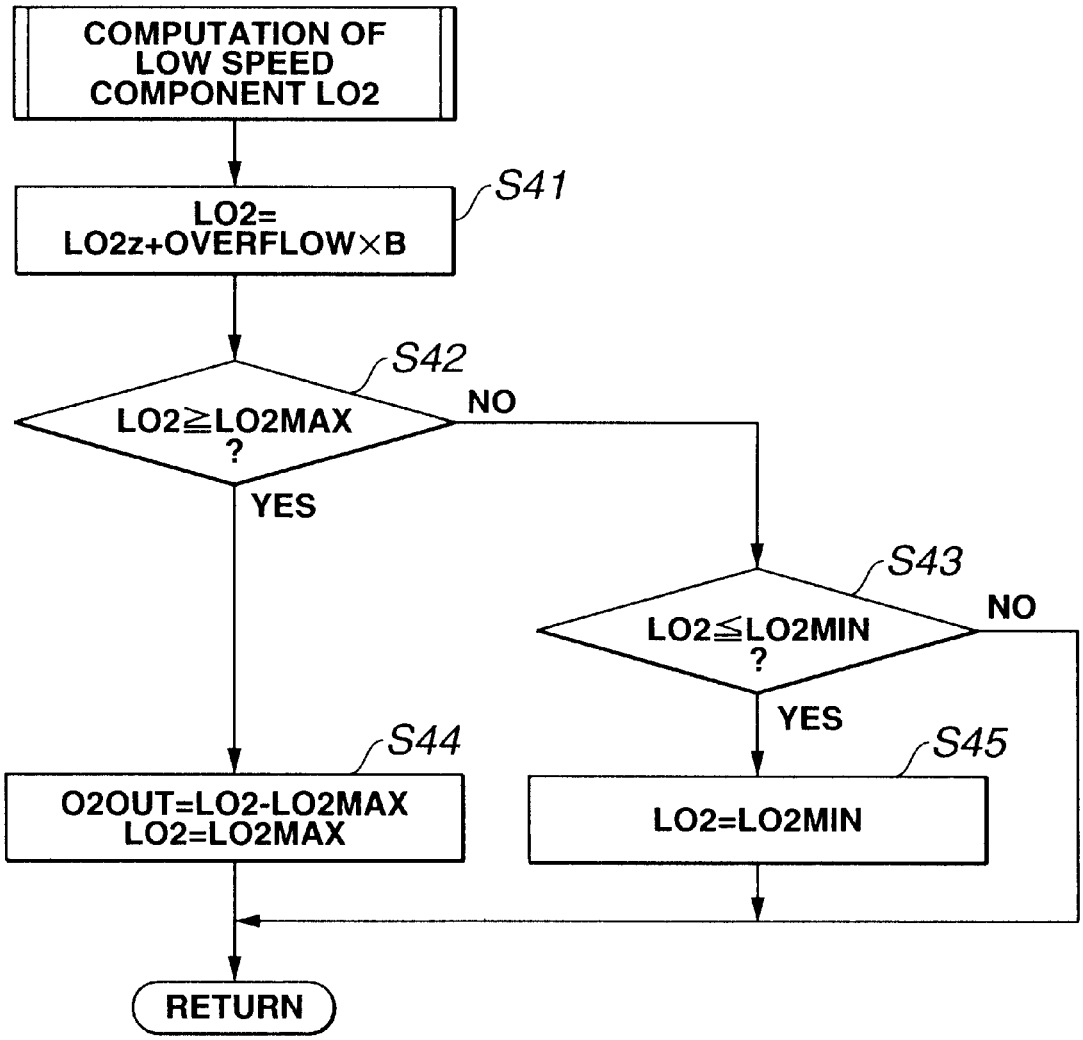
FIG. 6 is a flowchart showing a subroutine performed by the exhaust purifying apparatus of FIG. 1, for computing a low speed component (LO2) of the oxygen storage amount.

FIG. 6 shows a subroutine (of step S8) for computing low speed component LO2. This subroutine is designed to compute low speed component LO2 in accordance with overflow amount OVERFLOW overflowing high speed component HO2.

Step S41 computes low speed component LO2 according to the following equation (5).

$$LO2=LO2z+\text{OVERFLOW}\times B \quad (5)$$

LO2z: A previous (most recent) value of low speed component LO2

B: An oxygen storage/release rate of low speed component.

Oxygen storage/release rate B of low speed component LO2 is set to a positive value smaller than or equal to one. In reality, the characteristic of the rate differs between oxygen storage and oxygen release, and moreover, the real storage/release rate is affected by catalyst temperature TCAT, and low speed component LO2. Accordingly, it is optional to set the storage rate and the release rate separately as a variable. In this case, oxygen is excessive when overflow amount OVERFLOW is positive, and the oxygen storage rate B in this case is increased as catalyst temperature TCAT increases, and increased as low speed component LO2 becomes smaller. When overflow amount OVERFLOW is negative, oxygen is deficient, and the oxygen release rate B in this case is increased as catalyst temperature TCAT increases and as low speed component LO2 increases.

Steps S42 and S43 check whether the thus-determined low speed component LO2 is over a maximum capacity LO2MAX or under a minimum capacity LO2MIN (=0) as in the computation of high speed component HO2.

When low speed component LO2 is greater than or equal to maximum capacity LO2MAX, controller 6 proceeds from S42 to S44, and computes oxygen excess/deficiency amount O2OUT overflowing low speed component LO2 according to the following equation (6).

$$O2OUT=LO2-LO2\text{MAX} \quad (6)$$

Moreover, low speed component LO2 is limited to maximum capacity LO2MAX (L2O=LO2MAX) at step S44. Oxygen excess/deficiency amount O2OUT flows out of catalyst 3 toward the downstream side.

When low speed component LO2 is smaller than or equal to minimum capacity LO2MIN, controller 6 proceeds from S43 to S45, and limits low speed component LO2 to minimum capacity LO2MIN (LO2=LO2MIN).

Figure 7:
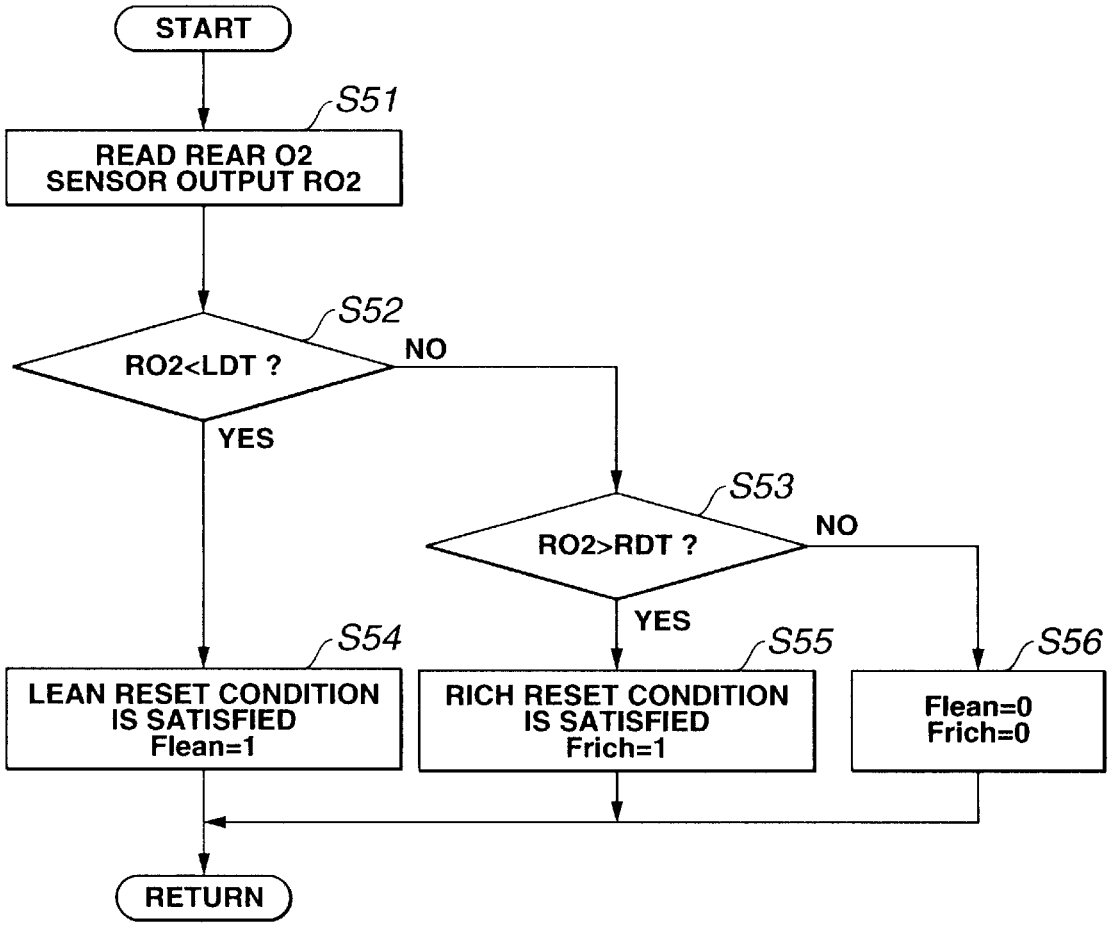
FIG. 7 is a flowchart showing a routine performed by the exhaust purifying apparatus of FIG. 1, for discriminating a reset condition.

FIG. 7 shows a routine for discriminating a reset condition to reset the oxygen storage amount. By resetting the oxygen storage amount, the system can cancel accumulated computation error, and thereby improve the accuracy in computation of the oxygen storage amount.

The routine of FIG. 7 checks the oxygen concentration on the downstream side of catalyst 3, determines whether the reset condition is satisfied to reset the oxygen storage amount (high speed component HO2 and low speed component LO2), and sets rich side flag Frich and a lean side flag Flean.

At step S51, controller 6 reads the output RO2 of rear O2 sensor 5 disposed on the downstream side of catalyst 3 to sense the oxygen concentration on the downstream side of catalyst 3. Then, controller 6 compares the rear O2 sensor output RO2 with a lean side threshold LDT for lean side judgment and a rich side threshold RDT for rich side judgment, at steps S52 and S53.

When rear O2 sensor output RO2 is lower than lean side threshold LDT, then controller 6 proceeds from step S52 to step S54, and sets the lean side flag Flean to one to indicate the fulfillment of a lean reset condition to reset the oxygen storage amount. When rear O2 sensor output RO2 is higher than rich side threshold RDT, then controller 6 proceeds from step S53 to step S55, and sets the rich side flag Frich to one to indicate the fulfillment of a rich reset condition to reset the oxygen storage amount.

When rear O2 sensor output RO2 is between lean side and rich side thresholds LDT and RDT, then controller 6 proceeds from step S53 to step S56, and resets the flags Flean and Frich to zero to indicate the unfulfillment of each of the lean reset condition and the rich reset condition.

The optimum thresholds to reduce the exhaust emissions vary in dependence on intake air amount Qa of engine 1. Therefore, each of the thresholds LDT and RDT is determined in accordance with the intake air amount Qa.

Figure 8:
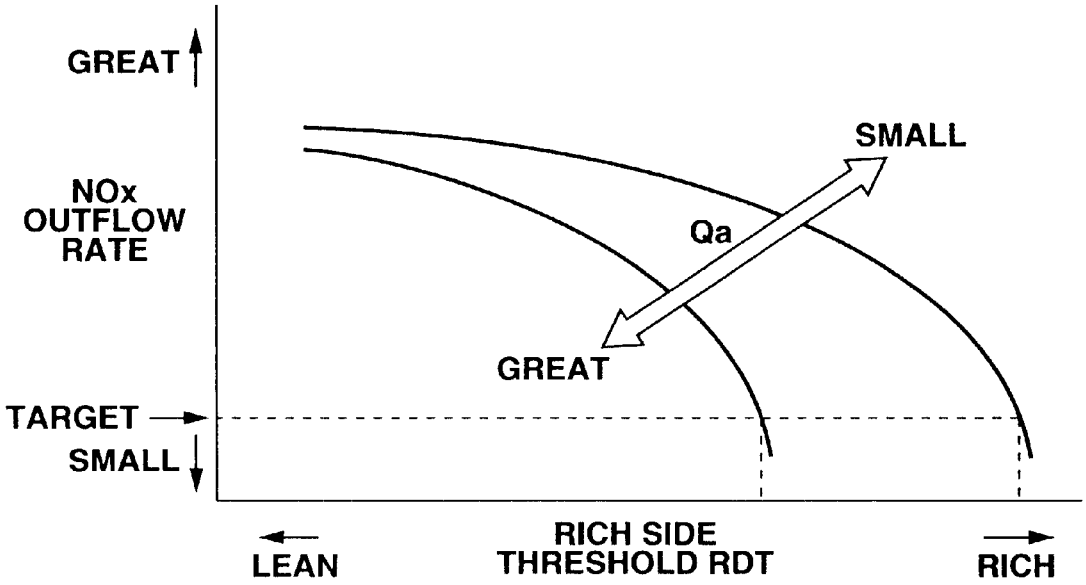
FIG. 8 is a graph showing a relationship between a rich side threshold used in the routine of FIG. 7, and an NOx outflow rate.

FIG. 8 shows a relationship, obtained experimentally, between the rich side threshold RDT and an NOx outflow rate (=a ratio of an amount of NOx flowing out of catalyst, to an amount of NOx flowing into catalyst). As shown in FIG. 8, a value of the rich side threshold RDT to achieve a target NOx outflow rate (3%, for example) is varied to the lean side as intake air amount Qa increases.

Adjustment of rich side threshold RDT to the lean side increases the likelihood of the rich reset to reset the computed oxygen storage amount to the minimum capacity. After the rich reset, engine 1 is operated at relatively lean air-fuel ratios so as to increase the oxygen storage amount.

It is possible to further decrease the NOx outflow rate by shifting rich side judgment threshold RDT, to the rich side of the value to achieve the target NOx outflow rate (as seen in FIG. 8). In this case, however, the outflow rates of HC and CO increase, and the exhaust emission tends to increase as a whole.

A relationship between lean side threshold LDT and the NOx release rate has a characteristic approximately identical to the characteristic shown in FIG. 8. A value of lean side threshold LDT to achieve the target NOx outflow rate is shifted to the lean side as intake air amount Qa increases.

Adjustment of lean side judgment threshold LDT to the lean side decreases the likelihood of the lean reset to reset the computed oxygen storage amount to the maximum capacity. After the lean reset, engine 1 is operated at relatively rich air-fuel ratios so as to decrease the oxygen storage amount. Thus, by decreasing the likelihood of the lean reset, the engine control system can indirectly increase the likelihood of the operation of engine in a relatively lean region.

Figure 9:
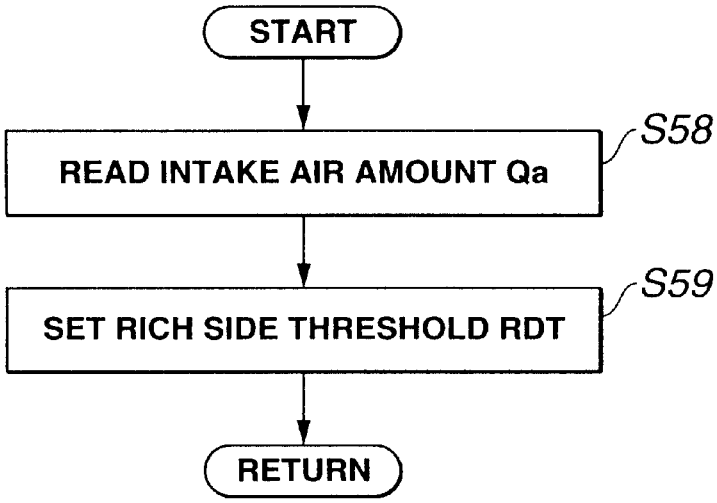
FIG. 9 is a flowchart showing a routine performed by the exhaust purifying apparatus of FIG. 1, for setting the rich side threshold.

FIG. 9 shows a routine for setting rich side threshold RDT.

Figure 10:
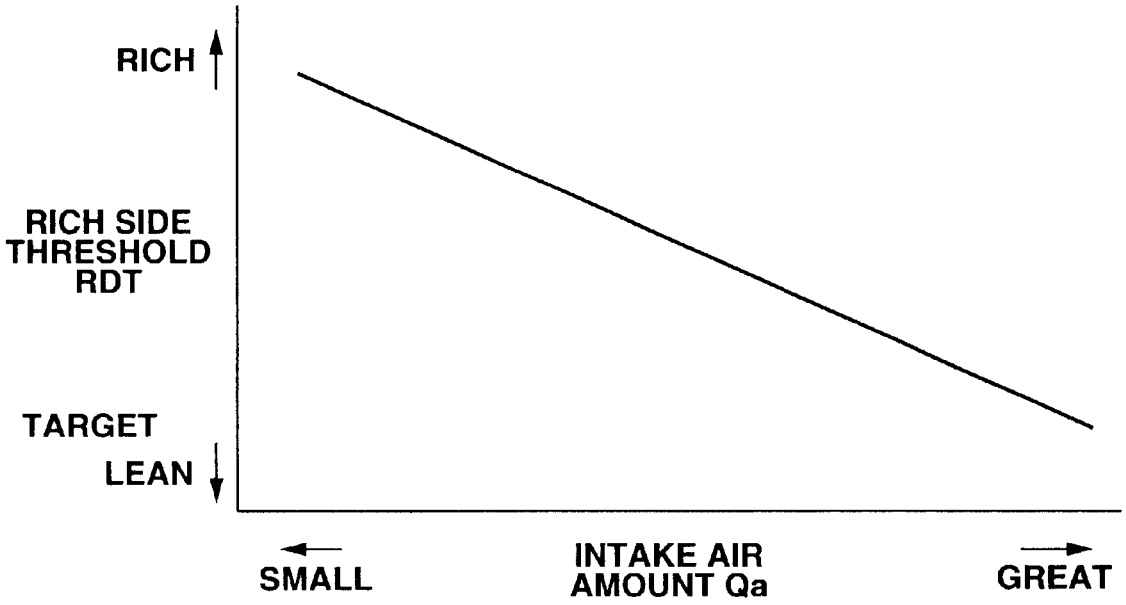
FIG. 10 is a graph showing a table used to determine the rich side threshold in accordance with an engine intake air amount.

At step S58, controller 6 reads intake air amount Qa of engine 1. Then, at step S59, controller 6 determines a value of rich side threshold RDT corresponding to the current value of intake air amount Qa by lookup from a table as shown in FIG. 10. Thus, rich side judgment threshold RDT is varied to the lean side as intake air amount Qa increases, and varied to the rich side as intake air amount Qa decreases. As shown in FIG. 10, the threshold decreases monotonically as Qa increases. In this example, the threshold decreases linearly as Qa increases.

A routine for setting lean side threshold LDT is similar to the routine of FIG. 9. Lean side threshold LDT is determined in dependence on intake air amount Qa by lookup from a table of a characteristic similar to the characteristic shown in FIG. 10. Thus, leans side threshold LDT is varied to the lean side as intake air amount Qa increases, and varied to the rich side as intake air amount Qa decreases.

In this example, rich side threshold RDT and lean side threshold LDT are determined by the two distinct routines. However, it is optional to first determine a center value between both thresholds, in accordance with intake air amount Qa by using a routine similar to the routine of FIG. 9, and then sets the rich side threshold RDT to a value resulting from addition of a predetermined fixed value d to the center value, and the lean side threshold value LDT to a value resulting from subtraction of the predetermined fixed value d from the center value. The relationship between the center value and intake air quantity Qa is similar to the characteristic shown in FIG. 10. The center value, and thresholds RDT and LDT are shifted to lean side as intake air quantity Qa increases. Because the predetermined value d is fixed, the interval between both thresholds RDT and LDT is always constant irrespective of variation in the center value.

Figure 11:
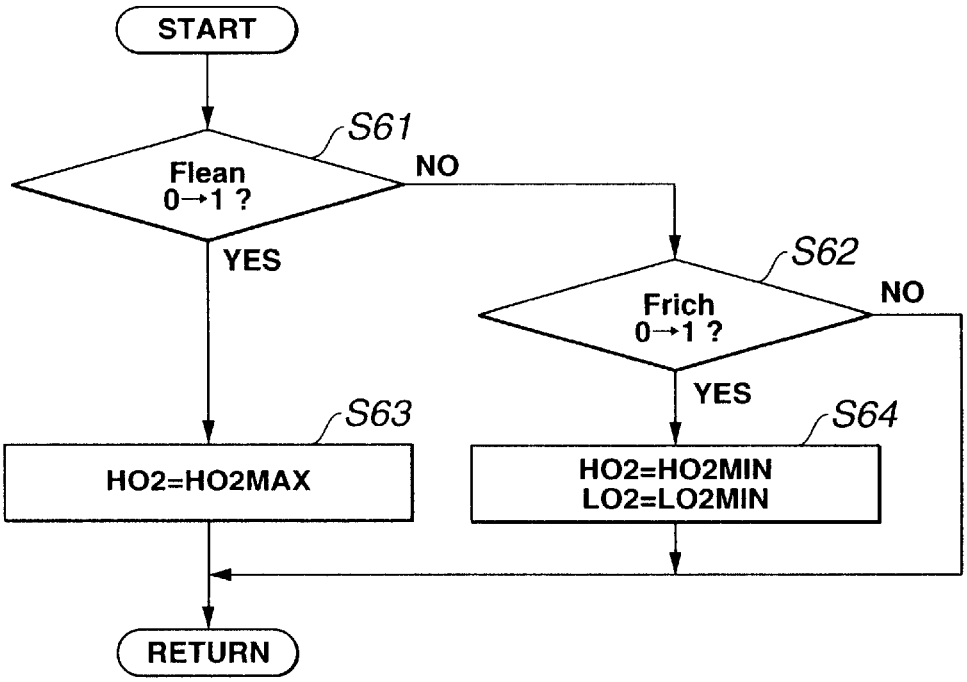
FIG. 11 is a flowchart showing a routine performed by the exhaust purifying apparatus of FIG. 1, for resetting the estimated oxygen storage amount.

FIG. 11 shows a routine for resetting the computed, estimated oxygen storage amount.

Steps S61 and S62 are steps for checking changes in lean side and rich side flags Flean and Frich, and determines whether the lean reset condition or rich reset condition is satisfied.

When fulfillment of the lean reset condition is confirmed by a change of lean side flag Flean from 0 to 1, controller 6 proceeds from step S61 to step S63, and resets high speed component HO2 of the oxygen storage amount to maximum capacity HO2MAX. In this case, controller 6 does not perform a resetting operation for low speed component LO2, and low speed component LO2 remains unchanged without being reset.

When fulfillment of the rich reset condition is confirmed by a change of rich side flag Frich from 0 to 1, controller 6 proceeds from step S62 to step S64, and resets high speed component HO2 and low speed component LO2 of the oxygen storage amount, respectively, to minimum capacities HO2MIN and LO2MIN.

These reset operations are based on the following idea. The oxygen storage rate of low speed component LO2 is slow. Therefore, after high speed component HO2 has reached the maximum capacity, xygen overflows to the downward side of the catalyst even if maximum capacity is not reached yet by low speed component LO2. Hence, it is possible to assume that at least the high speed component HO2 has reached the maximum capacity at the time point when the downstream side of the catalyst becomes lean.

At the time when the downstream side of the catalyst is rich, it is assumed that oxygen is not released even from low speed component LO2 releasing oxygen gradually. Each of high speed component HO2 and low speed component LO2 is considered to be in a state of minimum capacity, holding no or little oxygen.

Figure 12:
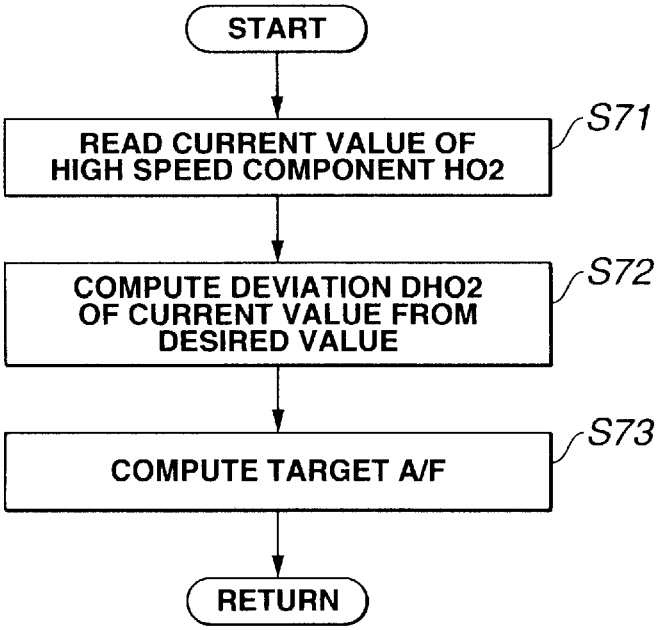
FIG. 12 is a flowchart showing a routine performed by the exhaust purifying apparatus of FIG. 1, for computing a target air-fuel ratio in accordance with the estimated oxygen storage amount.

FIG. 12 shows a routine for computing a target air/fuel ratio from the oxygen storage amount. Controller 6 of this example serves as a central unit of a control system performing an air/fuel ratio control (control to control the oxygen storage amount constant).

Controller 6 first reads high speed component HO2 of the current oxygen storage amount at step S71, and computes a deviation DHO2 of the current high speed component HO2 from a target high speed component value TGHO2 at step S72. (Deviation DHO2 is equal to oxygen excess/deficiency amount needed by catalyst 3.) The target high speed component value TGHO2 is set equal to a half of the maximum capacity HO2MAX of high speed component, in this example.

At step S73, controller 6 determines a target air-fuel ratio for engine 1 by converting the computed deviation DHO2 to a corresponding value of the air/fuel ratio.

Therefore, this routine of FIG. 12 sets the target air-fuel ratio to the lean side and functions to increase the oxygen storage amount (high speed component HO2) when high speed component HO2 of oxygen storage amount is smaller than the target value. When, on the other hand, the high speed component HO2 is greater than the target value, then the target air-fuel ratio for engine 1 is set to the rich side, and the routine functions to decrease the oxygen storage amount (high speed component HO2).

The thus-constructed exhaust purifying catalyst apparatus or system of this example is operated as follows:

When engine 1 is started, the exhaust purifying catalyst system starts the computation of oxygen storage amount of catalyst 3, and performs the air-fuel ratio control for engine 1 so as to hold the oxygen storage amount in catalyst 3 constant at a level to achieve a maximum conversion efficiency of catalyst 3.

The computation to estimate the oxygen storage amount in catalyst 3 is based on the air-fuel ratio of inflowing exhaust gas mixture flowing into catalyst 3, and the intake air amount to engine 1. In this example, the exhaust purifying catalyst system determines the oxygen storage amount by computing high speed component HO2 and low speed component LO2 separately in conformity with the real characteristic.

In this example, the computation is based on the assumption that, at the time of oxygen storage, high speed component HO2 stores oxygen first, and low speed component LO2 start storage when high speed component becomes unable to store any more. At the time of oxygen release, the assumption is that oxygen is released first from high speed component HO2 when the ratio (LO21/HO2) between low speed component LO2 and high speed component HO2 is smaller than or equal to the predetermined ratio AR, and oxygen is released from both of low speed component LO2 and high speed component HO2 so as to maintain the ratio AR when ratio LO2/HO2 becomes equal to ratio AR.

Then, the catalyst system controls the air-fuel ratio of engine 1 to the rich side and thereby decreases high speed component HO2 when high speed component HO2 is greater than the target value. When high speed component HO2 is smaller than the target value, the air-fuel ratio is controlled to the lean side to increase high speed component HO2.

Consequently, the catalyst system can hold the high speed component HO2 at the desired target value. Therefore, even if the air-fuel ratio of the inflowing exhaust gas mixture flowing into catalyst 3 deviates from the stoichiometry, the high speed component HO2 superior in response speed store or release oxygen immediately, and correct the air-fuel ratio of the catalyst atmosphere toward the stoichiometric ratio, so that the conversion efficiency of catalyst 3 is held at the maximum level.

Accumulation of errors during the computation increases the deviation between the estimated oxygen storage amount based on the computation and the actual oxygen storage amount. However, this catalyst system performs the reset operation to reset the estimated oxygen storage amount (high speed component HO2 and low speed component LO2) at the timing when the downstream side of catalyst 3 becomes rich or lean, and thereby corrects the deviation between the result of computation and the actual oxygen storage amount.

Figure 13:
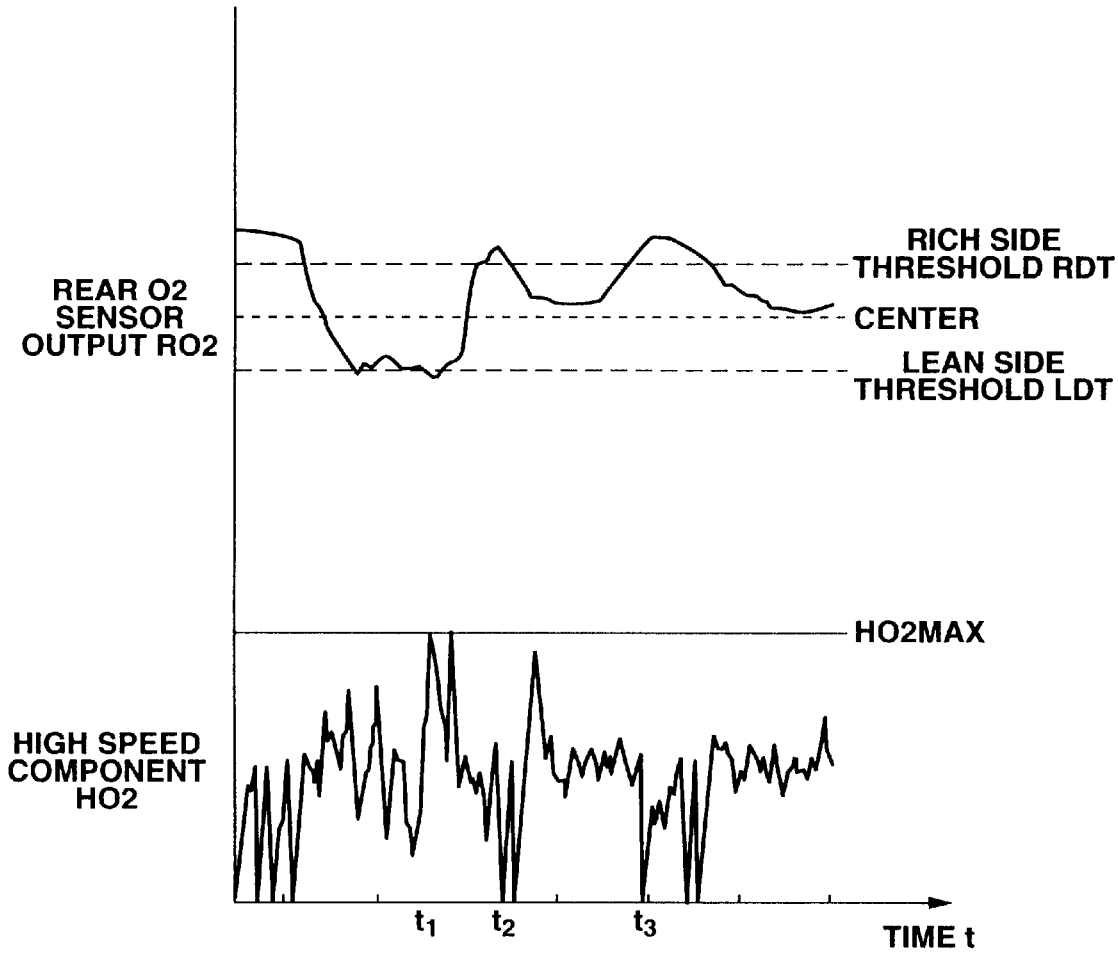
FIG. 13 is a time chart showing effects of the control for controlling the oxygen storage amount constant.

FIG. 13 shows variation of high speed component HO2 when the oxygen storage amount is controlled constant. In this example, the rear O2 sensor output RO2 becomes smaller than lean side judgment threshold LDT and the lean reset condition is met at instant t1. Therefore, high speed component HO2 is reset to maximum capacity HO2MAX. In this case, no resetting operation is performed to low speed component LO2 since low speed component LO2 is not necessarily at maximum.

At each of instant t2 and t3, rear O2 sensor output RO2 becomes greater than rich side threshold RDT and the rich reset condition is met. Therefore, high speed component HO2 is reset to minimum capacity HO2MIN. Minimum capacity HO2MIN is equal to zero in this example. In this case, low speed component LO2 too is reset to the minimum capacity.

By resetting the oxygen storage amount at the timing when the exhaust gas mixture on the downstream side of catalyst 3 becomes rich or lean, the exhaust purifying catalyst system according to this embodiment can correct the deviation between the result of the computation to estimate the oxygen storage amount and the actual oxygen storage amount, and further improve the accuracy of the estimation of oxygen storage amount. As a result, this system can improve the accuracy of the air-fuel ratio control to hold constant the oxygen storage amount, and maintain the high conversion efficiency of catalyst.

The thresholds RDT and LDT (or the center value between them) is adjusted to the lean side as the intake air amount Qa for engine 1 becomes greater. Thus, this catalyst system increases the likelihood of the rich reset when intake air amount Qa is greater, and decreases the likelihood of the lean reset, so that the tendency for engine 1 to be operated in a relatively lean region is increased. This catalyst system can increases the possibility of engine operation on the lean side and thereby optimize the purification efficiency for the exhaust emission control.

Figure 14:
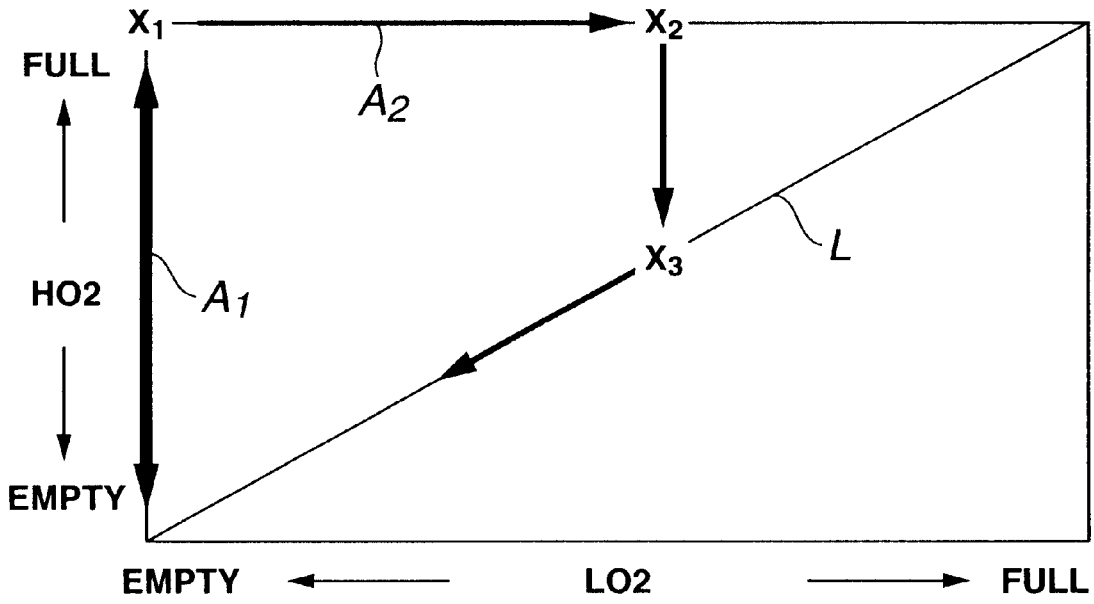
FIG. 14 is a graph showing an oxygen storage/release characteristic of the catalyst used in this embodiment.

FIG. 14 shows the oxygen storage/release characteristic of catalyst 3 employed in this example. The vertical axis shows the high speed component HO2 (an amount of oxygen stored in the noble metal) and the horizontal axis shows the low speed component LO2 (an amount of oxygen stored in the oxygen storage material).

In the normal running condition, low speed component LO2 is almost zero, and only high speed component HO2 varies according to the air-fuel ratio of exhaust flowing into the catalyst as shown by an arrow A1 in FIG. 14. High speed component HO2 is controlled, for example, to be half of its maximum capacity.

When, however, the fuel supply is cut off to the engine, or when engine 1 is restarted from the warm-up state (hot restart), the high speed component HO2 has reached its maximum capacity and oxygen is stored as the low speed component LO2 (arrow A2 in FIG. 14). The oxygen storage amount varies from a point X1 to a point X2.

When oxygen is released from the point X2, oxygen is preferentially released from high speed component HO2. When the ratio of low speed component LO2 to high speed component HO2 reaches a predetermined value (X3 in FIG. 14), oxygen is released from both the high speed component HO2 and low speed component LO2 so that the ratio of low speed component LO2 to high speed component HO2 is not varied. In other words, oxygen is released while moving on a straight line L shown in FIG. 14. On the line L, the low speed component LO2 is from 5 to 15, but preferably approximately 10, relative to the high speed component 1.

In the illustrated embodiment, at least one of step S1, step S11, S13, S58 and item 9 can correspond to means for sensing an engine intake air amount, and at least one of step S1, S11 and item 4 can correspond to means for sensing an upstream exhaust condition representing an air-fuel ratio of an inflowing exhaust gas mixture flowing into the catalyst. At least one of steps S51 and item 5 can correspond to means for sensing an downstream exhaust condition representing an air-fuel ratio of an outflowing exhaust gas mixture flowing out of the catalyst. At least one of steps S4~S8, S14, S22, S23, S36~S38, S44 and S45 can correspond to means for computing an estimated oxygen storage amount of the catalyst in accordance with the upstream exhaust condition of the inflowing exhaust gas mixture and the engine intake air amount. Step S73 can correspond to means for controlling an air fuel ratio of the engine in accordance with the oxygen storage amount. At least one of steps S63 and S64 can correspond to means for correcting the estimated oxygen storage amount to reduce an error in computing the estimated oxygen storage amount when the downstream exhaust condition becomes equal a predetermined threshold. At least step S59 can correspond to means for modifying the threshold in accordance with the intake air amount.

This application is based on a prior Japanese Patent Application No. 2001-131481. The entire contents of this Japanese Patent Application No. 2001-131481 with a filing date of Apr. 27, 2001 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An engine exhaust purifying apparatus comprising:

an air flow sensor arranged to sense an engine intake air amount;

a catalyst disposed in an engine exhaust passage;

an upstream exhaust sensor disposed in the engine exhaust passage on an upstream side of the catalyst, and arranged to sense an upstream exhaust condition representing an air-fuel ratio of an inflowing exhaust gas mixture flowing into the catalyst;

a downstream exhaust sensor disposed on a downstream side of the catalyst and arranged to sense a downstream exhaust condition representing an air-fuel ratio of an outflowing exhaust gas mixture flowing out of the catalyst; and a controller configured;

to compute an estimated oxygen storage amount of the catalyst in accordance with the air-fuel ratio of the inflowing exhaust gas mixture and the engine intake air amount;

to control an air-fuel ratio of the engine in accordance with the estimated oxygen storage amount so as to bring an actual oxygen storage amount of the catalyst to a desired value;

to correct the estimated oxygen storage amount to reduce an error in computing the estimated oxygen storage amount when the downstream exhaust condition sensed by the downstream exhaust sensor becomes equal to a predetermined threshold; and to modify the threshold in accordance with the intake air amount.

2. The engine exhaust purifying apparatus as claimed in claim 1, wherein the downstream exhaust condition is one of an oxygen concentration of the outflowing exhaust gas mixture and the air-fuel ratio of the outflowing exhaust gas mixture, and the controller is configured to determine the threshold as a function of the intake air amount and to correct the estimated oxygen storage amount by resetting the estimated oxygen storage amount to a predetermined setting when the downstream exhaust condition sensed by the downstream exhaust sensor becomes equal to the predetermined threshold.

3. The engine exhaust purifying apparatus as claimed in claim 1, wherein the controller is configured to modify the threshold to a lean side as the intake air amount increases.

4. The engine exhaust purifying apparatus as claimed in claim 1, wherein the threshold comprises a rich side threshold and a lean side threshold.

5. The engine exhaust purifying apparatus as claimed in claim 4, wherein the controller is configured to modify the rich side threshold to the lean side as the intake air amount increases.

6. The engine exhaust purifying apparatus as claimed in claim 4, wherein the controller is configured to modify the lean side threshold to the lean side as the intake air amount increases.

7. The engine exhaust purifying apparatus as claimed in claim 4, wherein the controller is configured to modify the rich side threshold and the lean side threshold to a lean side by shifting a center value between the rich side threshold and the lean side threshold to the lean side as the intake air amount increases.

8. The engine exhaust purifying apparatus as claimed in claim 1, wherein the controller is configured to compute the oxygen storage amount by computing a high speed component having a first oxygen storage rate and a low speed component having a second oxygen storage rate which is not equal to the first oxygen storage rate.

9. The engine exhaust purifying apparatus as claimed in claim 8, wherein the controller is configured to compute the oxygen storage amount according to such a characteristic that the high speed component stores oxygen prior to the low speed component, and the low speed component starts to store oxygen after the high speed component becomes unable to store oxygen.

10. The engine exhaust purifying apparatus as claimed in claim 8, wherein the controller is configured to compute the oxygen storage amount according to such a characteristic that the high speed component releases oxygen prior to the low speed component when a ratio of the low speed component to the high speed component is smaller than a predetermined value.

11. The engine exhaust purifying apparatus as claimed in claim 8, wherein the controller is configured to compute the oxygen storage amount according to such a characteristic that, when a ratio of the low speed component to the high speed component is greater than a predetermined value, oxygen is released from the high speed component and the low speed component so as to hold the ratio of the low speed component to the high speed component unchanged.

12. The engine exhaust purifying apparatus as claimed in claim 8, wherein the controller is configured to control the air fuel ratio of the engine so as to bring the high speed component to a desired value.

13. The engine exhaust purifying apparatus as claimed in claim 8, wherein the controller is configured to reset each of the high speed component and the low speed component to a minimum capacity when the downstream exhaust condition sensed by the downstream exhaust sensor becomes equal to the rich threshold.

14. The engine exhaust purifying apparatus as claimed in claim 8, wherein the controller is configured to reset the high speed component to a maximum capacity when the downstream exhaust condition sensed by the downstream exhaust sensor becomes equal to the lean threshold.

15. An engine exhaust purifying process for an engine equipped with a catalyst disposed in an engine exhaust passage, the engine exhaust purifying process comprising:

computing an estimated oxygen storage amount of the catalyst in accordance with a sensed upstream exhaust condition representing an air-fuel ratio of an inflowing exhaust gas mixture flowing into the catalyst and a sensed engine intake air amount;

controlling an air-fuel ratio of the engine in accordance with the estimated oxygen storage amount;

correcting the estimated oxygen storage amount to reduce an error in computing the estimated oxygen storage amount when a downstream exhaust condition representing an air-fuel ratio of an outflowing exhaust gas mixture flowing out of the catalyst becomes equal to a predetermined threshold; and modifying the threshold in accordance with the sensed engine intake air amount.

16. An engine exhaust purifying apparatus for an engine equipped with a catalyst, the engine exhaust purifying apparatus comprising:

means for sensing an engine intake air amount;

means for sensing an upstream exhaust condition representing an air-fuel ratio of an inflowing exhaust gas mixture flowing into the catalyst;

means for sensing an downstream exhaust condition representing an air-fuel ratio of an outflowing exhaust gas mixture flowing out of the catalyst; and means for computing an estimated oxygen storage amount of the catalyst in accordance with the upstream exhaust condition of the inflowing exhaust gas mixture and the engine intake air amount;

means for controlling an air fuel ratio of the engine in accordance with the oxygen storage amount;

means for correcting the estimated oxygen storage amount to reduce an error in computing the estimated oxygen storage amount when the downstream exhaust condition sensed by said means for sensing the downstream exhaust condition becomes equal to a predetermined threshold; and means for modifying the threshold in accordance with the intake air amount.

* * * * *